US007009444B1

(12) United States Patent
Scott

(10) Patent No.: US 7,009,444 B1
(45) Date of Patent: Mar. 7, 2006

(54) TEMPERATURE STABLE VOLTAGE REFERENCE CIRCUIT USING A METAL-SILICON SCHOTTKY DIODE FOR LOW VOLTAGE CIRCUIT APPLICATIONS

(75) Inventor: Greg Scott, Inkom, ID (US)

(73) Assignee: AMI Semiconductor, Inc., Pocatello, ID (US)

( * ) Notice: Subject to any disclaimer, the term of this patent is extended or adjusted under 35 U.S.C. 154(b) by 152 days.

(21) Appl. No.: 10/770,233

(22) Filed: Feb. 2, 2004

(51) Int. Cl.
*G05F 1/10* (2006.01)

(52) U.S. Cl. ..... 327/535; 327/513

(58) Field of Classification Search ..... 327/512, 327/513, 534, 535, 537, 538, 539, 540, 541, 327/542, 543
See application file for complete search history.

(56) References Cited

U.S. PATENT DOCUMENTS 4,956,567 A * 9/1990 Hunley et al. ..... 327/540
5,955,793 A * 9/1999 Khadkikar et al. ..... 307/117
6,052,020 A 4/2000 Doyle ..... 327/539
6,184,743 B1 2/2001 Swart ..... 327/538
6,489,835 B1 12/2002 Yu et al. ..... 327/539
6,529,066 B1 3/2003 Guenot et al. ..... 327/539
6,531,857 B1 3/2003 Ju ..... 323/316
6,642,778 B1 11/2003 Opris ..... 327/539
6,737,848 B1 * 5/2004 Goetz et al. ..... 323/313

* cited by examiner

*Primary Examiner*—Jeffrey Zweizig
(74) *Attorney, Agent, or Firm*—Workman Nydegger

(57) ABSTRACT

Silicon-based voltage reference circuits that generate a temperature independent voltage reference that is less than even the silicon bandgap potential. The voltage reference circuit includes a diode-connected metal-silicon Schottky diode that is biased with a current. In this configuration, the anode terminal of the Schottky diode is a CTAT voltage source in this configuration. The anode terminal has a voltage at zero degrees Kelvin at the barrier height of the Schottky diode, which may differ depending on the metal chosen, but in most cases is less than the bandgap potential of silicon. The voltage reference circuit also includes a PTAT voltage source. The PTAT voltage may be generated in a variety of ways. An amplifier amplifies the PTAT voltage, and a summer adds the CTAT voltage to the amplified PTAT voltage to generate the temperature stable voltage reference.

11 Claims, 5 Drawing Sheets

TEMPERATURE STABLE VOLTAGE REFERENCE CIRCUIT USING A METAL-SILICON SCHOTTKY DIODE FOR LOW VOLTAGE CIRCUIT APPLICATIONS

BACKGROUND OF THE INVENTION

1. The Field of the Invention

The present invention relates to the field of voltage reference circuits. In particular, the present invention relates to circuits and methods for providing a voltage reference that uses a metal-silicon Schottky diode for the Complementary proportional To Absolute Temperature (CTAT) voltage source that is added to a properly amplified PTAT voltage source to form a temperature stable voltage reference for low voltage applications.

2. Background and Related Art

The accuracy of circuits often depends on access to a stable bandgap voltage reference. A bandgap voltage reference is a voltage reference approximately equal to the bandgap potential (VG0) of the semiconductor at zero degrees Kelvin.

The bandgap voltage reference circuit is often configured by adding two voltages together: one that is inversely or Complementary proportional To Absolute Temperature (CTAT), and one that is Proportional To Absolute Temperature (PTAT). The CTAT voltage decreases approximately linearly with absolute temperature, whereas the PTAT voltage increases approximately linearly with absolute temperature.

The CTAT voltage source is typically the base-emitter voltage (VBE) of a diode-connected bipolar transistor. FIG. 5 illustrates a plot of the base-emitter voltage (VBE) represented on the vertical axis as a function of absolute temperature in degrees Kelvin represented on the horizontal axis. The slope of the base-emitter voltage VBE versus temperature is dependent on the current density through the bipolar transistor. For example, approximate line 501 represents the VBE versus temperature function when the current density is relatively low; approximate line 502 represents the VBE versus temperature function when the current density is moderate; and approximate line 503 represents the VBE versus temperature function when the current density is relatively high. In each case, however, the base-emitter voltage (VBE) at zero degrees Kelvin (i.e., the Y-intercept of FIG. 5) is equal to the bandgap of the semiconductor at zero degrees Kelvin (VG0). In the case of FIG. 5, VG0 is shown as 1.2 volts which approximates the bandgap voltage for silicon at zero Kelvin.

A close approximation to this relationship is shown in the following Equation 1:

$$VBE = VGO - V_T LN\left(\frac{I_O}{I_D}\right) \quad (1)$$

Where, $I_D$ is the diode current;

$I_O$ is a process and geometry specific current approximately twenty orders of magnitude higher than the diode reverse saturation current, $I_S$, for the semiconductor ($I_O$ is usually significantly higher than the diode current $I_D$);

$V_T$ is the thermal voltage which is equal to kT/q, where k is the well-known Boltzmann constant, T is absolute temperature, and q is the well-known charge of an electron.

To form a PTAT voltage, the difference between the base-emitter voltage (VBE) of two bipolar transistors is used, where the current density is different for each bipolar transistor. As shown in FIG. 6, the difference between VBE for the high biased diode corresponding to line 503 and the low biased diode 501 is a linearly increasing function with a Y intercept of zero.

The curve depicted in FIG. 6 can be described by the relationship described in Equation 2 as follows:

$$\Delta V_{BE} = V_T LN\left(\frac{J_2}{J_1}\right) \quad (2)$$

where $J_{1\ and\ J2}$ are the respective current densities flowing through the emitters of the transistors, and is equal to the current flowing through the emitter $I_E$ divided by the emitter area $A_E$.

In order to form the bandgap voltage reference, the PTAT voltage (VPTAT, in this case ΔVBE) is multiplied by a constant G. The result is added to the CTAT voltage (VCTAT, in this case VBE) to obtain the output voltage VOUT. This is represented mathematically by the following Equation 3:

$$VOUT = VCTAT + G \cdot VPTAT \quad (3)$$

and also by the following Equation 4:

$$VOUT = VBE(J_1) + G \cdot [VBE(J_1) - VBE(J_2)] \quad (4)$$

The constant G is chosen to make the slope of G•VPTAT versus temperature equal in magnitude but opposite in sign to the slope of VCTAT versus temperature. This yields a voltage VOUT which is substantially independent of temperature as depicted in FIG. 7, and is approximately equal to the bandgap potential of the semiconductor.

FIG. 8 schematically illustrates a conventional circuit 800 that produces the relationship described by Equation 4. This conventional circuit 800 is especially employed in Silicon CMOS processes in which parasitic PNP bipolar transistors are available having a substrate that serves as the collector. The conventional circuit 800 includes two bipolar transistors 801 and 802.

The current density $J_1$ passing through bipolar transistor 801 is equal to the current I1 divided by its emitter area A1. The current density $J_2$ passing through bipolar transistor 802 is equal to the current I2 divided by its emitter area A2. The voltage at the emitter terminal of bipolar transistor 801 (i.e., VBE(J1)) is provided to the positive input terminal of the amplifier 803. The voltage at the emitter terminal of bipolar transistor 802 (i.e., VBE(J2)) is provided to the negative input terminal of the amplifier 803. The amplifier 803 has gain G. Accordingly, a voltage of G•(VBE(J1)−VBE(J2)) is applied at the output terminal of the amplifier 803. The output voltage VOUT is obtained by summing 807 the output voltage of the amplifier 803 with the base-emitter voltage of the bipolar transistor 801.

The currents I1 and I2, and the emitter areas A1 and A2 are chosen such that the voltage VBE(J1) at the emitter terminal of bipolar transistor 801 is larger than the emitter voltage VBE(J2) at the emitter terminal of bipolar transistor 802 and such that the difference in base emitter voltages (i.e., VBE(J1) minus VBE(J2)) is significantly larger than the offset voltage of the amplifier 803.

The current sources 805 and 806 used to bias the respective bipolar transistors 801 and 802 are typically generated using the output voltage VOUT of the bandgap reference circuit 800. If the supply voltage does not affect the currents through either bipolar transistor, the output voltage is independent of the supply voltage as well as temperature for higher supply voltages.

In order to minimize the dependence of the output voltage VOUT on temperature, the bipolar transistors 801 and 802 should be carefully matched. Matching of devices is quite difficult. Minor and yet inevitable spatial process variations often cause some mismatch between common devices.

FIG. 9 schematically illustrates an alternative bandgap voltage reference circuit 900 along with an associated timing diagram 910. The bandgap voltage reference circuit 900 only uses one bipolar transistor 901. Accordingly, there is no matching issue between two bipolar transistors as there is with the bandgap voltage reference circuit 800 of FIG. 8. Furthermore, power consumption is reduced since there is only one bipolar transistor drawing current. The bandgap voltage reference 900 requires a low frequency clock signal $\phi_1$, and a non-overlapping complement, $\phi_2$.

During the period when $\phi_1$ is high, a higher current I1 is passed through the bipolar transistor 901 creating a higher base-emitter voltage VBE(J1) which is sampled and stored on capacitor C1. J1 is the current density through the bipolar transistor 901 when the total current is I1. During the period when $\phi_2$ is high, a lower current I2 is placed through the bipolar transistor 902 generating a lower base-emitter voltage VBE(J2) which is sampled and stored on capacitor C2. Again, to generate the relationship described by Equation 4, the difference between these two voltages is multiplied by a specific gain G using an amplifier 903. The amplified voltage is then added to the higher VBE voltage. Once again, the amplifier gain G is chosen such that the resulting output voltage VOUT is a constant with respect to temperature.

Each of these conventional bandgap voltage reference circuits 800 and 900 are effective in generating a bandgap voltage reference that is approximately equal to the bandgap potential of the underlying semiconductor as long as the high supply voltage is sufficiently high for the amplifiers 803 and 903 to generate voltages below and approaching the bandgap potential (1.2 volts in the case of silicon). Accordingly, as supply voltages drop to and below 1.2 volts, the performance of circuits 800 and 900 will degrade. With lower voltage applications becoming more prevalent, voltage references that are lower than the bandgap potential of the semiconductor may be useful.

Accordingly, what would be advantageous are silicon-based voltage reference circuits that provide voltage references that are relatively independent of temperature and below the bandgap potential of silicon. It would especially be advantageous if such reference circuits may operate with lower supply voltages.

BRIEF SUMMARY OF THE INVENTION

The principles of the present invention are directed towards silicon-based voltage reference circuits that, contrary to conventional silicon-based bandgap voltage reference circuits, generate a relatively temperature and power supply independent voltage references that are less than even the bandgap potential of silicon.

The silicon-based voltage reference circuit includes a metal-silicon Schottky diode. A current source supplies a current through the metal-silicon Schottky diode. In this configuration, the anode terminal of the Schottky diode is a Complementary proportional To Absolute Temperature (CTAT) voltage source. The anode terminal has a voltage at zero degrees Kelvin of approximately the barrier height of the metal-silicon Schottky diode, which is less than the bandgap potential for silicon for most selections of metal.

The voltage reference circuit also includes a Proportional To Absolute Temperature (PTAT) voltage source that generates a PTAT voltage that has a slope with temperature that is approximately equal to, but opposite in sign, to the CTAT voltage. This PTAT voltage may be generated in a variety of ways, conventional or otherwise. A summer adds the CTAT voltage to the PTAT voltage to generate the temperature stable reference voltage that is less than the bandgap voltage of silicon.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The principles of the present invention are directed towards silicon-based voltage reference circuits that, contrary to conventional silicon-based bandgap voltage reference circuits, generate temperature stable voltage references that are less than the bandgap potential of silicon, and that may operate with supply voltages that are less than the silicon bandgap potential.

Figure 1:
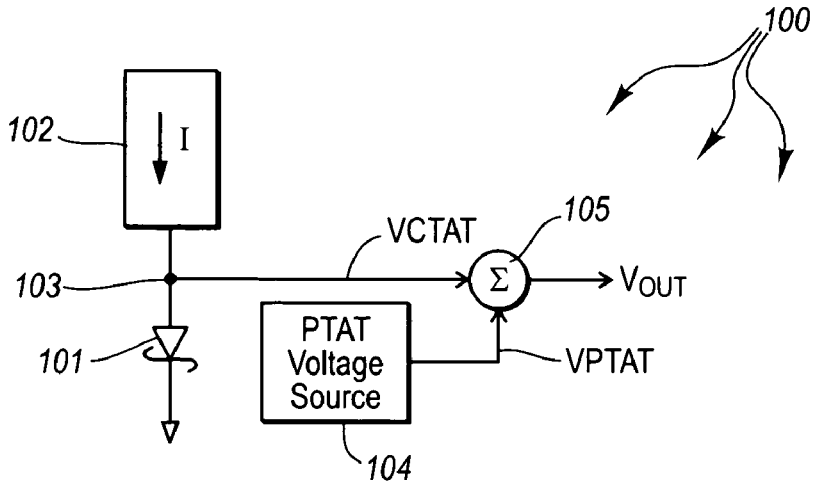
FIG. 1 schematically illustrates a silicon-based voltage reference that uses a biased metal-silicon Schottky diode to generate a Complementary proportional To Absolute Temperature (CTAT) voltage in accordance with the principles of the present invention.

FIG. 1 schematically illustrates a silicon-based voltage reference 100 that uses a biased metal-silicon Schottky diode 101 to generate a Complementary proportional To Absolute Temperature (CTAT) voltage in accordance with the principles of the present invention. A current source 102 supplies a current I through the metal-silicon Schottky diode 101. In this configuration, the anode terminal 103 of the metal-silicon Schottky diode 101 is a Complementary proportional To Absolute Temperature (CTAT) voltage source. The anode terminal 103 has a voltage at zero degrees Kelvin at the barrier height of the metal-silicon Schottky diode. The barrier height depends on the metal chosen. In this description and in the claims, the "metal" in a metal-silicon Schottky diode may include any metal or even metal silicide. For example, TiSi2 is a transition metal silicide that may be used to obtain a barrier height of approximately 0.6V. However, the choice of metal is not limited to TiSi2 as there are many metals having a barrier height that is below the bandgap potential of silicon.

The voltage reference circuit also includes a Proportional To Absolute Temperature (PTAT) voltage source 104 that generates a PTAT voltage that has a positive slope with temperature that is approximately equal to the negative slope with temperature of the CTAT voltage at the node terminal 103. The PTAT voltage 103 may be generated in a variety of ways. The principles of the present invention are not restricted to the manner in which the PTAT voltage is generated. A summer 105 adds the CTAT voltage to the PTAT voltage to generate the temperature stable reference voltage VOUT that is less than the bandgap voltage of silicon.

As previously mentioned, the PTAT voltage source 104 may be any mechanism for generating a PTAT voltage. However, for illustrative purposes, three examples of PTAT voltage sources will be described with respect to FIGS. 2A through 2C.

Figure 2A:
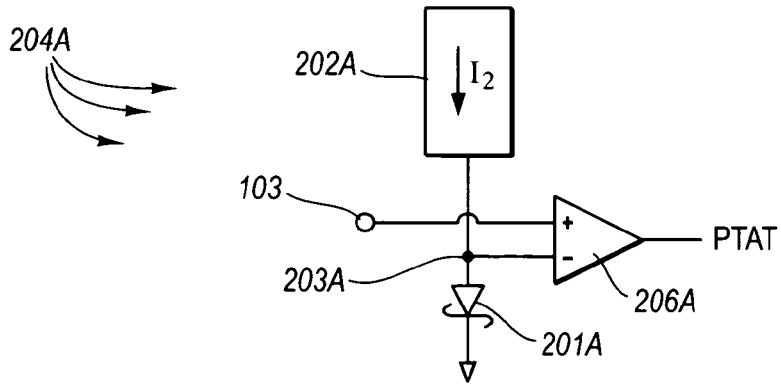
FIG. 2A illustrates an embodiment of the Proportional To Absolute Temperature (PTAT) voltage source of FIG. 1 in which a voltage differential across two metal-silicon Schottky diodes including the metal-silicon Schottky diode of FIG. 1 is used as the PTAT voltage.

FIG. 2A illustrates an embodiment 204A of the PTAT voltage source 104 of FIG. 1. The PTAT voltage source 204A uses a voltage differential across the anode voltage of two metal-silicon Schottky diodes (including the metal-silicon Schottky diode 101) of FIG. 1.

Referring to FIG. 2A, the PTAT voltage source 204A includes a second metal-silicon Schottky diode 201A. A second current source 202A is configured during operation to supply a current through the second metal-silicon Schottky diode 201A to a low voltage supply (such as ground) such that the second metal-silicon Schottky diode 201A has a current density that is different than the current density passing through the first metal-silicon Schottky diode 101. An amplifier 206A has a negative input terminal that is coupled to the anode terminal 203A of the second metal-silicon Schottky diode, and a positive input terminal that is coupled to the anode terminal 103 of the first metal-silicon Schottky diode 101. The voltage differential between two metal-silicon Schottky diodes is a PTAT voltage. The amplifier 206A amplifies this voltage as appropriate to generate another PTAT voltage that has a positive slope with temperature that is equal in magnitude to the slope with temperature of the CTAT voltage present at the anode terminal 103 of the first metal-silicon Schottky diode.

Figure 2B:
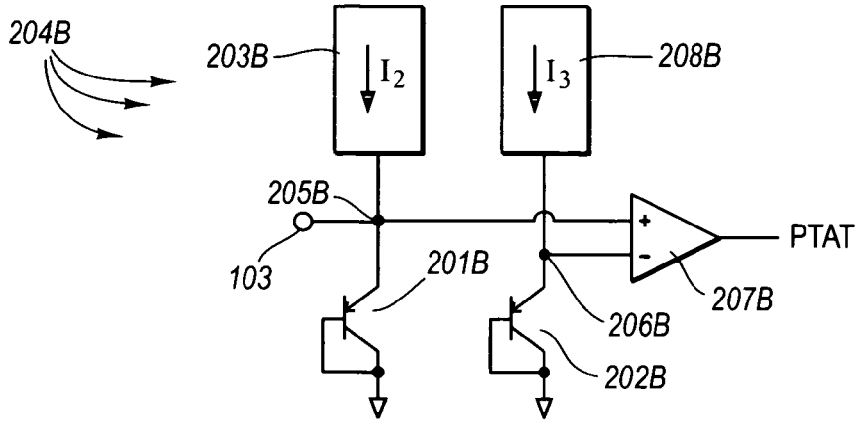
FIG. 2B illustrates an alternative embodiment of the PTAT voltage source of FIG. 1 in which different base-emitter voltages of two bipolar transistors are used as the PTAT voltage.

FIG. 2B illustrates a second embodiment 204B of the PTAT voltage source 104 of FIG. 1. The PTAT voltage source 204B uses a voltage differential between base-emitter voltages of two bipolar transistors as a PTAT voltage. Referring to FIG. 2B, the PTAT voltage source 204B includes two bipolar transistors 201B and 202B. A current source 203B is configured during operation to provide a current I2 through the base-emitter interface of the bipolar transistor 201B such that the base-emitter terminal of the bipolar transistor 201B has a certain current density. A current source 208B is configured during operation to provide a current I3 through the base-emitter interface of the bipolar transistor 202B such that the base-emitter terminal of the bipolar transistor 202B has a current density that is different than the current density of the first bipolar transistor 201B. An amplifier 207B has a negative input terminal that is coupled to the emitter terminal 205B of the bipolar transistor 201B, and a positive input terminal that is coupled to the emitter terminal 206B of the second bipolar transistor 202B. The voltage differential between the emitter voltages of the two bipolar transistors is a PTAT voltage. The amplifier 207B amplifies this voltage as appropriate to generate another PTAT voltage that has a positive slope with temperature that is equal in magnitude to the slope with temperature of the CTAT voltage present at the anode terminal 103 of the first metal-silicon Schottky diode.

Figure 2C:
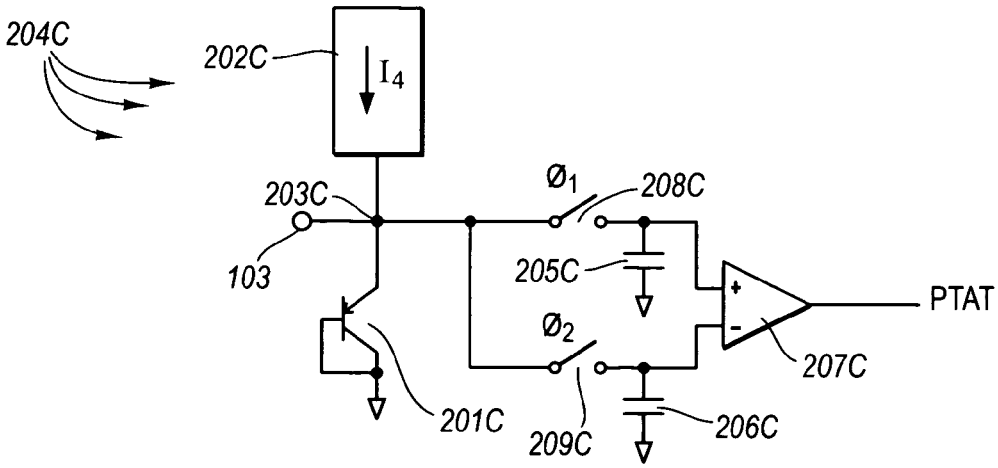
FIG. 2C illustrates an alternative embodiment of the PTAT voltage source of FIG. 1 in which a single bipolar transistor provides the differential base-emitter voltage for use as the PTAT voltage.

FIG. 2C illustrates a third embodiment 204C of the PTAT voltage source of FIG. 1. The PTAT voltage source 204C uses a single bipolar transistor 201C to provide the differential base-emitter voltage for use as the PTAT voltage. Referring to FIG. 2C, the PTAT voltage source 204C includes a single a bipolar transistor 201C. An alternating current source 202C is configured to supply a current through the base-emitter interface of the bipolar transistor during a first time period such that the base-emitter terminal of the bipolar transistor 201C has a certain current density during that time period. The alternating current source 202C is also configured to supply a current through the bipolar transistor during a second time period that is non-overlapping with the first time period such that the base-emitter terminal of the bipolar transistor 201C has a different current density during the second time period.

A capacitor 205C is configured to sample a voltage at the base-emitter terminal 203C of the bipolar transistor 201C during the first time period through switch 208C. A second capacitor 206C is configured to sample a voltage at the base-emitter terminal of the bipolar transistor 201C during the second time period through switch 209C. An amplifier 207C has a negative input terminal coupled to the second capacitor 206C so as to receive the voltage sampled by the second capacitor 206C, and a positive input terminal coupled to the first capacitor 205C so as to receive the voltage sampled by the first capacitor 205C. The voltage differential between the emitter voltages of the bipolar transistors sampled while experiencing different current densities is a PTAT voltage. The amplifier 207C amplifies this voltage as appropriate to generate another PTAT voltage that has a positive slope with temperature that is equal in magnitude to the slope with temperature of the CTAT voltage present at the anode terminal 103 of the first metal-silicon Schottky diode.

Figure 3:
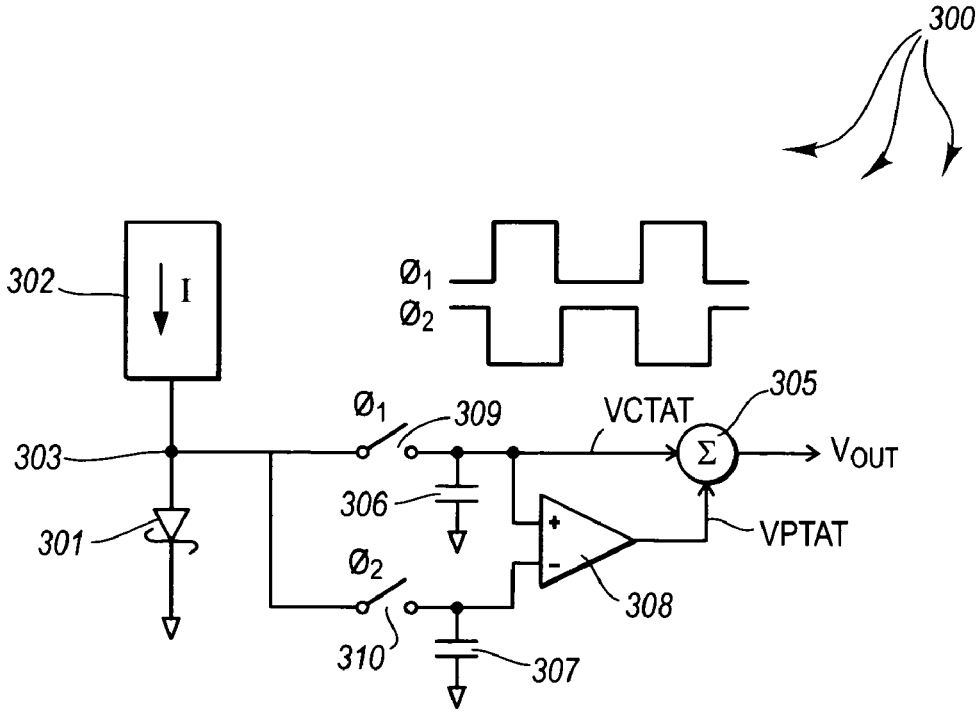
FIG. 3 illustrates an embodiment of the silicon-based voltage reference circuit of FIG. 1 in which the anode voltage of the Schottky diode is sampled at different times to provide the CTAT and PTAT voltages.

FIG. 3 illustrates an embodiment 300 of the silicon-based voltage reference circuit 100 of FIG. 1 in which the anode voltage of the Schottky diode is sampled at different times to provide the CTAT and PTAT voltages. The metal-silicon Schottky diode 301 and the summer 305 may be similar as described above for the metal-silicon Schottky diode 101 and the summer 105 of FIG. 1.

The current source 302 is specially configured as an alternating current source to supply a current through the metal-silicon Schottky diode 301 during a first time period (e.g., when clock signal $\Phi_1$ is high) such that the anode/cathode interface of the metal-silicon Schottky diode 301 has a first current density during that time period. The alternating current source 302 also supplies a different current through the metal-silicon Schottky diode during a second time period that is non-overlapping with the first time period (e.g., when clock signal (12 is high) such that the metal-silicon interface of the metal-silicon Schottky diode 301 has a different current density during that second time period.

A first capacitor 306 is configured to sample a voltage at the anode terminal 303 of the metal-silicon Schottky diode 301 during the first time period through the switch 309. A second capacitor 307 is configured to sample a voltage at the anode terminal 303 of the metal-silicon Schottky diode 301 during the second time period through the switch 310. An amplifier 308 has a negative input terminal coupled to the second capacitor 307 so as to receive the voltage sampled by the second capacitor, and a positive input terminal coupled to the first capacitor 306 so as to receive the voltage sampled by the first capacitor. The summer 305 sums the voltage at the output terminal of the amplifier 308 (which is a PTAT voltage), with the voltage at the positive input terminal of the amplifier (which is a CTAT voltage) to generate the output voltage.

There are a number of ways to generate the alternating current source 302 as will be apparent to one of ordinary skill in the art after having reviewed this description. Two examples are illustrated in FIGS. 4A and 4B.

Figure 4A:
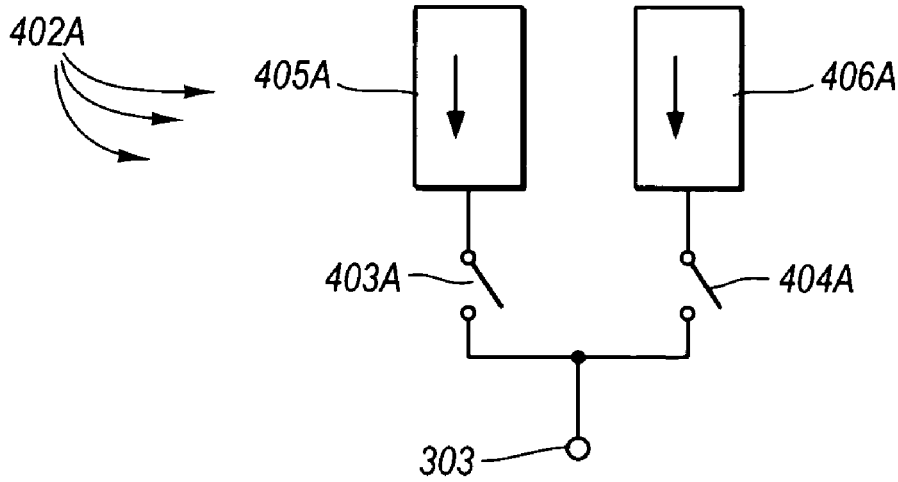
FIG. 4A illustrates a first embodiment of the current source of FIG. 3.

FIG. 4A illustrates an alternating current source 402A that includes a first switch 403A that is configured to be closed during the first time period (when signal $\Phi_1$ is high), and a second switch 404A that is configured to be closed during the second time period (when signal $\Phi_2$ is high). When the switch 403A is closed, a current source 405A supplies a current through the metal-silicon Schottky diode such that the metal-silicon Schottky diode has the first current density. When the switch 404A is closed, a current source 406A supplies a current through the metal-silicon Schottky diode such that the metal-silicon Schottky diode a different current density.

Figure 4B:
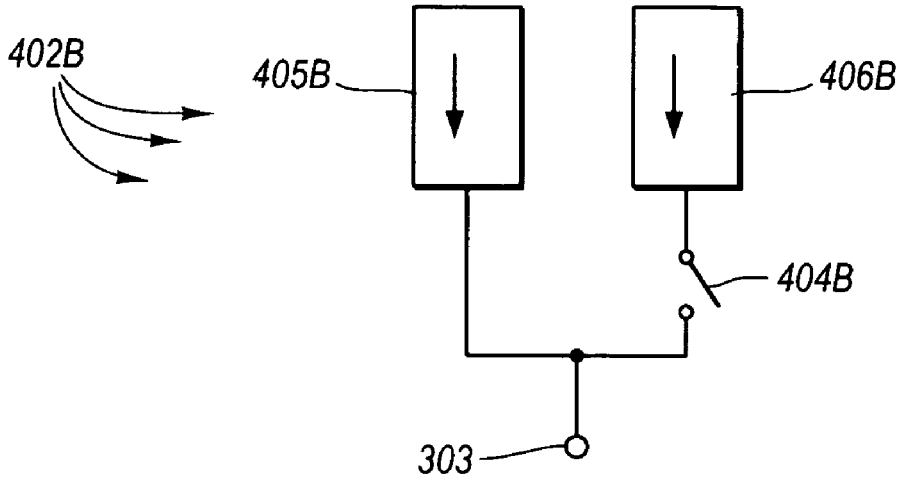
FIG. 4B illustrates a second embodiment of the current source of FIG. 3.
Figure 5:
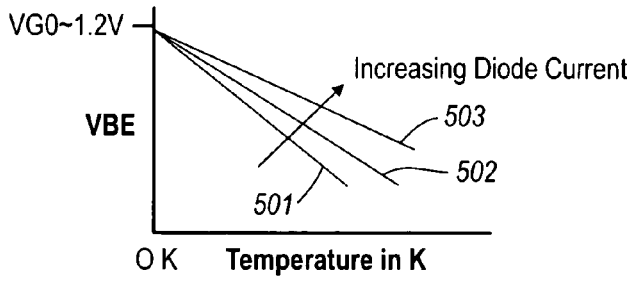
Fig. 5 (Prior Art)
FIG. 5 illustrates the known physical relationships between a base-emitter voltage, temperature, and current density.
Figure 6:
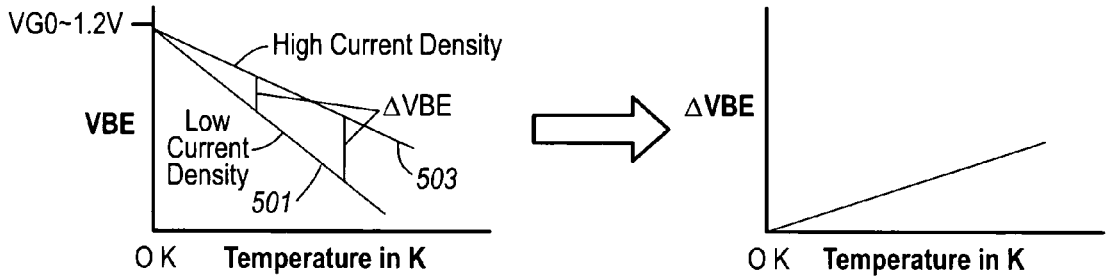
Fig. 6 (Prior Art)
FIG. 6 illustrates the known physical relationships between the difference in base-emitter voltages due to different current densities at different temperatures.
Figure 7:
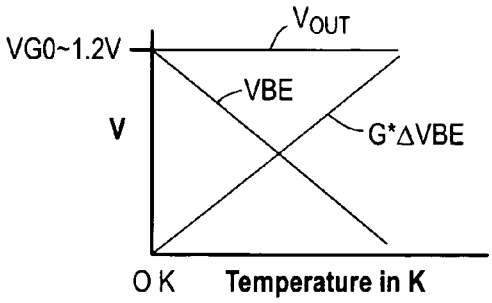
Fig. 7 (Prior Art)
FIG. 7 illustrates the addition of a CTAT voltage to a PTAT voltage to generate a voltage that is relatively stable with temperature.
Figure 8:
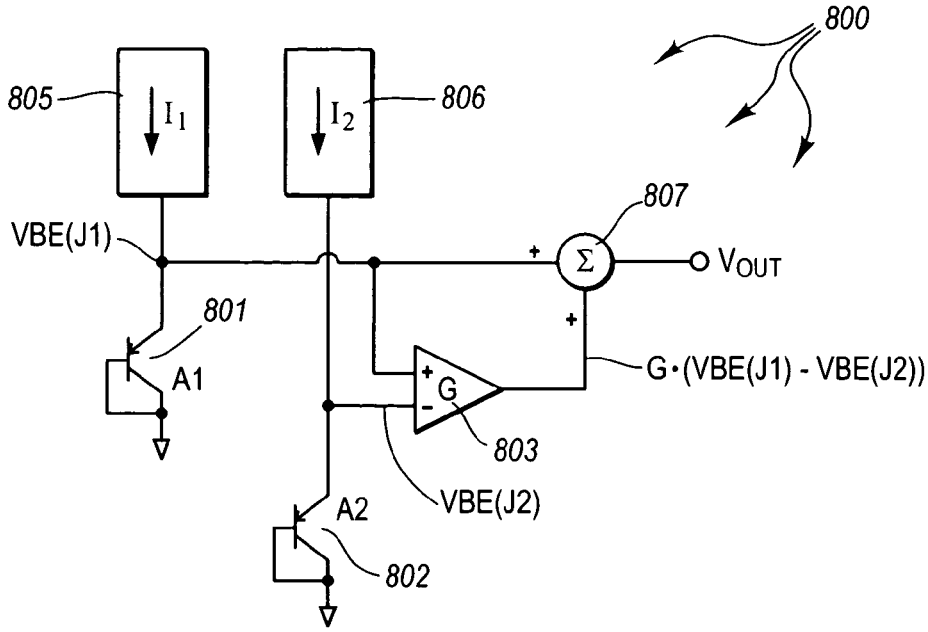
Fig. 8 (Prior Art)
FIG. 8 illustrates a conventional bandgap voltage reference in which two bipolar transistors with different current densities are used to generate both the CTAT and PTAT voltages.
Figure 9:
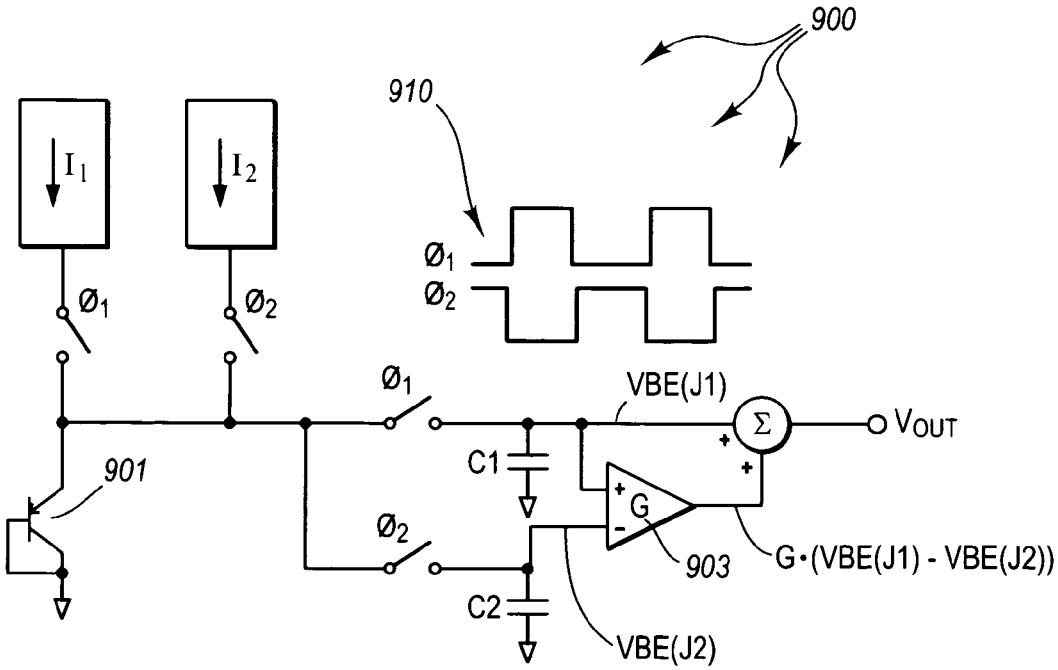
Fig. 9 (Prior Art)
FIG. 9 illustrates a conventional bandgap voltage reference in which a single bipolar transistor with different current densities sampled at different times is used to generate both the CTAT and PTAT voltages.

FIG. 4B illustrates an alternating current source 402B that includes a current source 405B configured to supply a current through the metal-silicon Schottky diode such that the metal-silicon Schottky diode has a first current density. A second current source 406B is configured when the switch 404B is closed to supply additional current through the metal-silicon Schottky diode such that the metal-silicon Schottky diode has a third current density, wherein the first current density added to the third current density is equal to the second current density.

All of the embodiments described herein use the node voltage of the metal-silicon Schottky diode as the CTAT voltage source. The value of this voltage at zero degrees Kelvin is just the barrier height of the metal-silicon barrier, which is most often below the bandgap potential of silicon. When added to a suitably amplified PTAT voltage, the result is a temperature stable voltage reference that may be below the bandgap potential of silicon. Accordingly, the principles of the present invention are suitable for low voltage application in which low, but yet temperature stable, reference voltages are useful, and in which supply voltages may be low as well. Furthermore, this may be done using silicon, arguably one of the most well understood semiconductors.

The silicon-based voltage reference 300 of FIG. 3 is particular useful in that a single silicon-metal Schottky diode 301 is used. This is particularly advantageous as device matching can be even more difficult for Schottky diodes than for bipolar transistors. Furthermore, since only one Schottky diode draws current, and since lower supply voltages may be used, power requirements are reduced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes, which come within the meaning and range of equivalency of the claims, are to be embraced within their scope.

What is claimed and desired secured by United States Letters Patent is:

1. A silicon-based voltage reference circuit that generates a reference voltage that is less than the bandgap potential of silicon, and that is stable with temperature and supply voltage fluctuations, the voltage reference circuit comprising the following:

a metal-silicon Schottky diode;

a current source configured during operation to supply a current through the metal-silicon Schottky diode to a low voltage supply such that the metal-silicon Schottky diode has a current density;

a PTAT voltage source configured to generate a PTAT voltage; and a summer having a first input terminal coupled to the PTAT voltage source so as to receive the PTAT voltage, and having a second input terminal coupled to the anode terminal of the metal-silicon Schottky diode to thereby sum the PTAT voltage with the voltage at the anode terminal of the metal-silicon Schottky diode.

2. A silicon-based voltage reference circuit in accordance with claim 1, wherein the current source is a first current source, the current density is a first current density, the metal-silicon Schottky diode is a first metal-silicon Schottky diode, the PTAT voltage source comprising the following:

a second metal-silicon Schottky diode;

a second current source configured during operation to supply a current through the second metal-silicon Schottky diode to a second low voltage supply such that the second metal-silicon Schottky diode has a second current density different than the first current density; and an amplifier having a negative input terminal coupled to the anode terminal of the second metal-silicon Schottky diode, and a positive input terminal coupled to the anode terminal of the first metal-silicon Schottky diode.

3. The silicon-based bandgap voltage reference circuit in accordance with claim 2, wherein the first current source is configured during operation to pass a current through only one Schottky diode, the first metal-silicon Schottky diode.

4. The silicon-based bandgap voltage reference circuit in accordance with claim 3, wherein the second current source is configured during operation to pass a current through only one Schottky diode, the second metal-silicon Schottky diode.

5. A silicon-based voltage reference circuit in accordance with claim 1, wherein the current source is a first current source, the current density is a first current density, and the PTAT voltage source comprises the following:

a first bipolar transistor;

a second current source configured during operation to provide a current through the first bipolar transistor such that the base-emitter terminal of the first bipolar transistor has a second current density;

a second bipolar transistor;

a third current source configured during operation to provide a current through the second bipolar transistor such that the base-emitter terminal of the second bipolar transistor has a third current density that is different than the second current density; and an amplifier having a negative input terminal coupled to the emitter terminal of the first bipolar transistor, and a positive input terminal coupled to the emitter terminal of the second bipolar transistor.

6. A silicon-based voltage reference circuit in accordance with claim 1, wherein the current source is a first current source, the current density is a first current density, and the PTAT voltage source comprises the following:

a bipolar transistor;

a second current source configured to supply a current through the bipolar transistor during a first time period such that the base-emitter terminal of the bipolar transistor has a second current density, and configured to supply a current through the bipolar transistor during a second time period that is non-overlapping with the first time period such that the base-emitter terminal of the bipolar transistor has a third current density that is different than the second current density;

a first capacitor configured to sample a voltage at the emitter terminal of the bipolar transistor during the first time period;

a second capacitor configured to sample a voltage at the emitter terminal of the emitter terminal of the metal-silicon Schottky diode during the second time period; and an amplifier having a negative input terminal coupled to the second capacitor so as to receive the voltage sampled by the second capacitor, and a positive input terminal coupled to the first capacitor so as to receive the voltage sampled by the first capacitor.

7. The silicon-based bandgap voltage reference circuit in accordance with claim 1, wherein the current source is configured during operation to pass a current through only one Schottky diode, the metal-silicon Schottky diode.

8. The silicon-based bandgap voltage reference circuit in accordance with claim 1, wherein the current density is a first current density, the current source being configured to supply a current through the metal-silicon Schottky diode during a first time period such that the anode terminal of the metal-silicon Schottky diode has the first current density, and configured to supply a current through the metal-silicon Schottky diode during a second time period that is non-overlapping with the first time period such that the anode terminal of the metal-silicon Schottky diode has a second current density that is different than the first current density, the silicon-based voltage reference circuit further comprising the following:

a first capacitor configured to sample a voltage at the anode terminal of the metal-silicon Schottky diode during the first time period;

a second capacitor configured to sample a voltage at the anode terminal of the metal-silicon Schottky diode during the second time period;

an amplifier having a negative input terminal coupled to the second capacitor so as to receive the voltage sampled by the second capacitor, and a positive input terminal coupled to the first capacitor so as to receive the voltage sampled by the first capacitor; and a summer having a first input terminal coupled to an output terminal of the amplifier, and having a second input terminal coupled to the positive terminal of the amplifier.

9. A silicon-based bandgap voltage reference in accordance with claim 8, wherein the current source comprises the following:

a first switch that is configured to be closed during the first time period;

a second switch that is configured to be closed during the second time period;

a first current source configured when the first switch is closed to supply a current through the metal-silicon Schottky diode such that the metal-silicon Schottky diode has the first current density; and a second current source configured when the second switch is closed to supply a current through the metal-silicon Schottky diode such that the metal-silicon Schottky diode has the second current density.

10. A silicon-based bandgap voltage reference in accordance with claim 8, wherein the current source comprises the following:

a first switch that is configured to be closed during the second time period;

a first current source configured to supply a current through the metal-silicon Schottky diode such that the metal-silicon Schottky diode has the first current density; and a second current source configured when the first switch is closed to supply a current through the metal-silicon Schottky diode such that the metal-silicon Schottky diode has a third current density, wherein the first current density added to the third current density is equal to the second voltage.

11. A silicon-based voltage reference in accordance with claim 1, wherein the metal-silicon Schottky diode is composed of TiSi2 as the metal.

* * * * *

UNITED STATES PATENT AND TRADEMARK OFFICE

CERTIFICATE OF CORRECTION

PATENT NO. : 7,009,444 B1
APPLICATION NO. : 10/770233
DATED : March 7, 2006
INVENTOR(S) : Greg Scott It is certified that error appears in the above-identified patent and that said Letters Patent is hereby corrected as shown below:

Column 3
Line 31, after "transistor", change "902" to --901--

Column 5
Line 53, after "voltage", change "103" to --VPTAT--

Column 7
Line 33, change "(12" to --$\Phi_2$--

Column 8
Line 25, change "particular" to --particularly--

Signed and Sealed this

Twenty-fourth Day of October, 2006

JON W. DUDAS
*Director of the United States Patent and Trademark Office*